US007163403B1

(12) United States Patent
Klotzle et al.

(10) Patent No.: US 7,163,403 B1
(45) Date of Patent: Jan. 16, 2007

(54) ROTATING ELECTRICAL TRANSFER COMPONENTS

(75) Inventors: Chad S. Klotzle, Townsend, MA (US); James A. Young, Dracut, MA (US)

(73) Assignee: Diamond Antenna and Microwave Corp., Littleton, MA (US)

( * ) Notice: Subject to any disclaimer, the term of this patent is extended or adjusted under 35 U.S.C. 154(b) by 0 days.

(21) Appl. No.: 10/859,011

(22) Filed: Jun. 2, 2004

(51) Int. Cl.
*H01R 39/00* (2006.01)

(52) U.S. Cl. ..... 439/23; 439/26

(58) Field of Classification Search ..... 439/17–19, 439/23–26; 310/238, 239
See application file for complete search history.

(56) References Cited

U.S. PATENT DOCUMENTS

| | | | | |
|---|---|---|---|---|
| 3,771,106 A | | 11/1973 | Matsumoto et al. | 439/23 |
| 4,372,633 A | * | 2/1983 | Allen et al. | 439/17 |
| 4,714,819 A | | 12/1987 | Yamashita | 219/216 |
| RE32,805 E | | 12/1988 | Engelmore et al. | 439/26 |
| 4,850,880 A | | 7/1989 | Zayat, Jr. et al. | 439/11 |
| 5,346,400 A | * | 9/1994 | Shin | 439/17 |
| 5,348,481 A | | 9/1994 | Ortiz | 439/25 |
| 5,809,136 A | | 9/1998 | Turner | 379/438 |
| 5,853,294 A | * | 12/1998 | Rehder | 439/17 |
| 5,865,629 A | | 2/1999 | Bernardini | 439/26 |
| 5,923,114 A | * | 7/1999 | Senni | 310/232 |
| 6,612,849 B1 | | 9/2003 | Scott | 439/23 |
| 6,658,729 B1 | | 12/2003 | Brodsky | 29/832 |

* cited by examiner

*Primary Examiner*—Khiem Nguyen
(74) *Attorney, Agent, or Firm*—Hayes Soloway PC

(57) ABSTRACT

The transfer apparatus is directed toward electrical transfer components providing an electrical connection to a rotating object. The transfer apparatus includes a stator base mounted proximate to the rotating object. An axle rotatably mounts at least one conductive disk to the stator base. The conductive disk is held against the rotating object. As the rotating object rotates about a first axis, the conductive disk is made to rotate about a second axis, the second axis otherwise maintaining a static position. A rotationally immobile contact is maintained in substantial electronic contact with the conductive disk whereby a lead wire may be connected to the immobile contact.

18 Claims, 6 Drawing Sheets

ROTATING ELECTRICAL TRANSFER COMPONENTS

TECHNICAL FIELD

This invention relates generally to improvements in rotating signal and power electrical connector components used in both sliding and rolling interface transfer mechanisms. More particularly, the invention relates to improved current transfer devices for conducting currents between stator and rotor members of electrically conductive mechanisms.

BACKGROUND OF THE INVENTION

The present invention is directed toward electrical transfer components between a rotary member and a stator member. FIG. 1 and FIG. 2 contain an example of a rotary member 12 and a stator member 14. In an application such as the radar for a ship, the rotary member 12 is in a constant state of rotation about an axis. The stator member 14 may be an object that completely encircles the rotary member 12, as shown in FIG. 1 and FIG. 2, or it may be located on only one side of the rotary member 12. In either case, the stator member 14 is proximate to the rotary member 12 at a substantially constant distance.

The rotary member 12 and stator member 14 may be capable of transferring low voltage signals as well as power. The rotary member 12 and stator member 14 may transfer a plurality of circuits. In the embodiment shown in FIG. 1 and FIG. 2, rotary contacts 16 are axially stacked in the rotary member 12 such that electrical contact can be made with each of the rotary contacts 16 at any point along the circumference of the rotary member 12. A corresponding number of stator conductors 18 are run to the stator member 14, such that when an electrical transfer component is installed between the rotary member 12 and the stator member 14, current flows between the rotary contacts 16 and the stator conductors 18. A special type of electrical connector is then needed to transfer electrical current between the rotary member 12 and the stator member 14. A slip ring 20, shown in FIG. 3, is one such electrical connector.

Slip rings 20 have a long history of applications for the transfer of electrical energy between, a stator member 14 and a rotary member 12. This transfer is affected by conducting the electrical signals and power from one member to the other member through a sliding contact 22. Typically, the sliding contact 22 is a conductive brush that is firmly mounted to the stator member 14 and maintains electrical contact with the rotary member 12 by sliding along one of the rotary contacts 16. This electrical connection technique achieves sliding electrical interface configurations for both low level signals and for power transfer. However, the regular and constant use, required for many transfer components connecting stator and rotary members, results in significant wear and tear on the sliding contact 22 over short periods of time. Therefore, even properly operating slip rings require constant maintenance at significant expense.

The large variety of electrical transfer requirements, specified by the broad field of users, introduces another problem for sliding transfer, which has both design and cost ramifications. Each new design of the transfer mechanism requires new tooling, fixtures, and molds. This demand of new designs results in long delivery schedules from definition to unit delivery as well as increased manufacturing costs. Since envelope parameters of diameter, length and shape as well as performance requirements of voltage, current, waveform, frequency and electrical resistance noise (or signal quality) establish many of the design requirements of the transfer unit, each application configuration and design is unique. This situation identifies why new non-recurring design and tooling costs accrue with each new set of specifications. Ideally, a new transfer mechanism would be designed that could be retrofitted to existing transfer mechanisms cost effectively.

One design configuration of the rotary member consists of stacked sets of rings and spacers to form an axial series of single non-shielded circuits. This design provides annulus channels for rolling interconnection balls, in lieu of brushes, between the inner and the outer circuit rings. This configuration provides for repeated use of common contact rings and spacers and the elimination of a molding process, which can effect cost reductions, the leads must be attached, and the rings machined and plated, individually. The labor associated with handling individual components drives the cost of production upward. Additionally, the cost of the configuration is adversely affected by the labor required to feed the lead wires through the individual rings and spacers during the assembly process. The assembly complexity and associated high manufacturing cost of the described configuration is particularly apparent for transfer units that require more than one hundred circuits.

Additionally the greater wear debris of slip rings exacerbates an electrical insulative breakdown problem of adjacent circuits when adequate barriers are not provided. When a rotary transfer mechanism is used in severe environmental conditions, even wiper seals built into the housings are not able to prevent a measure of moisture and contaminants from entering the unit. These contaminants combined with wear debris from the slip rings often results in electrical bridging between adjacent circuits and electrical insulative failure of the unit if adequate barriers are not provided. Circuit barriers are difficult to mold or machine into the module without breakage because of the small axial thickness which is available in the design. In addition, the barrier must be formed from the same insulating plastic material the rings are set in which results in a brittle, and easily damaged, protective wall.

Thus, a heretofore unaddressed need exists in the industry to address the aforementioned deficiencies and inadequacies.

SUMMARY OF THE INVENTION

Embodiments of the present invention provide an apparatus and method for providing an electrical connection between relatively rotating elements.

Briefly described, in architecture, one embodiment of the system, among others, can be implemented as follows. A transfer apparatus provides an electrical connection to a rotating object constantly rotating about a first axis. The transfer apparatus includes a stator base mounted proximate to the rotating object. An axle rotatably mounts at least one conductive disk to the stator base. The conductive disk is held against the rotating object. The conductive disk rotates about a second axis while maintaining a substantially static position. A rotationally immobile contact is maintained in substantial electronic contact with the conductive disk whereby a lead wire may be connected to the contact to complete electrical transfer.

The present invention can also be viewed as providing methods for accomplishing electronic transfer between relatively rotating elements. In this regard, one embodiment of such a method, among others, can be broadly summarized by the following steps: mounting an axle to a base; rotatably mounting at least one conductive disk to the base about the axle, the conductive disk held against the object, wherein rotation of the object causes the conductive disk to rotate about a second axis while maintaining a substantially static position; and mounting a rotationally immobile contact to the axle and in substantial electrical contact with the conductive disk whereby a lead wire may be connected to the immobile contact.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
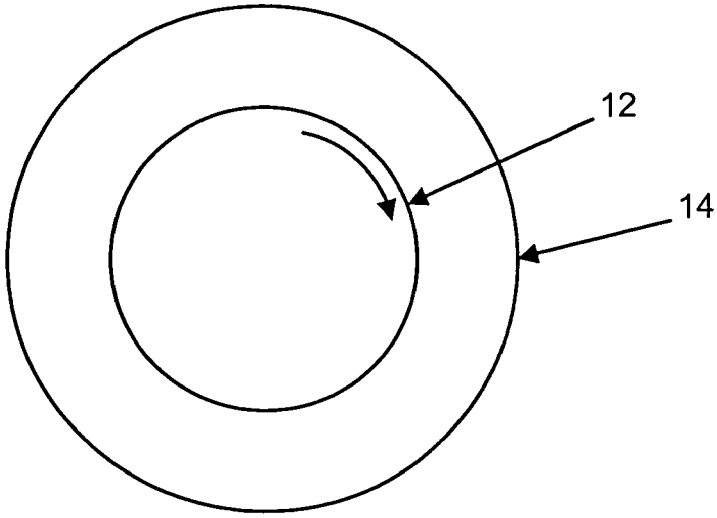
FIG. 1 PRIOR ART
FIG. 1 is a cross-sectional top view of a rotary member and a stator member in the prior art.
Figure 2:
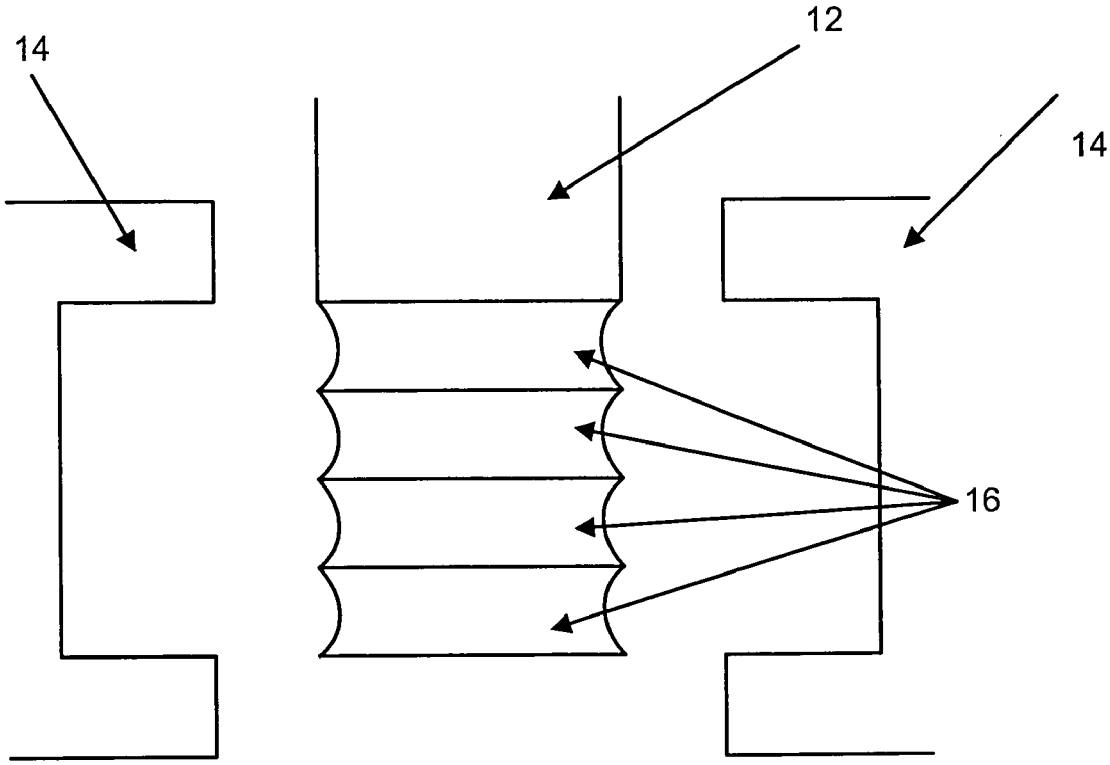
FIG. 2 PRIOR ART
FIG. 2 is a cross-sectional side view of the rotary member and the stator member in the prior art, according to FIG. 1.
Figure 3:
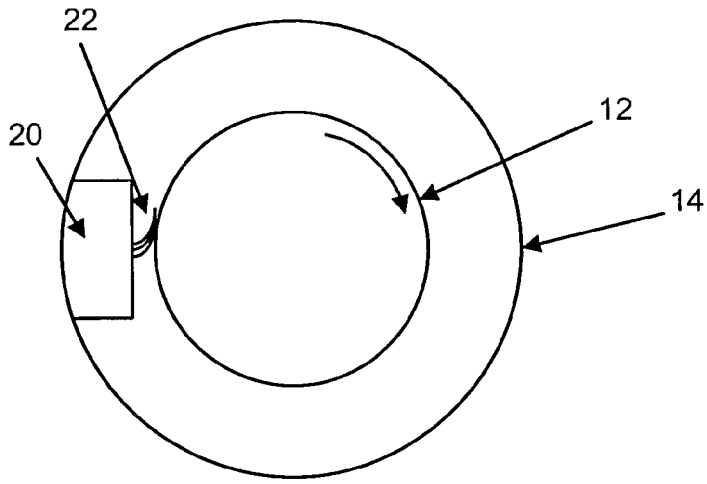
FIG. 3 PRIOR ART
FIG. 3 is a cross-sectional top view of a slip ring assembly in the prior art used to connect a rotary member and a stator member.
Figure 4:
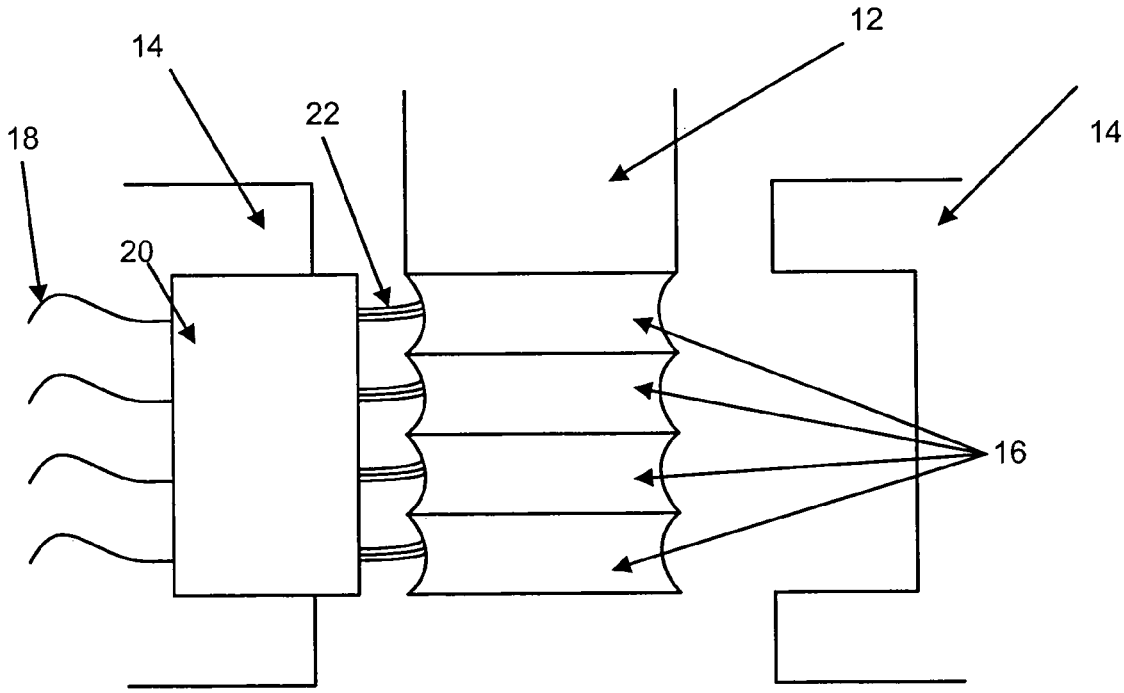
FIG. 4 PRIOR ART
FIG. 4 is a cross-sectional side view of a slip ring assembly in the prior art used to connect a rotary member and a stator member, in accordance with FIG. 3.
Figure 5:
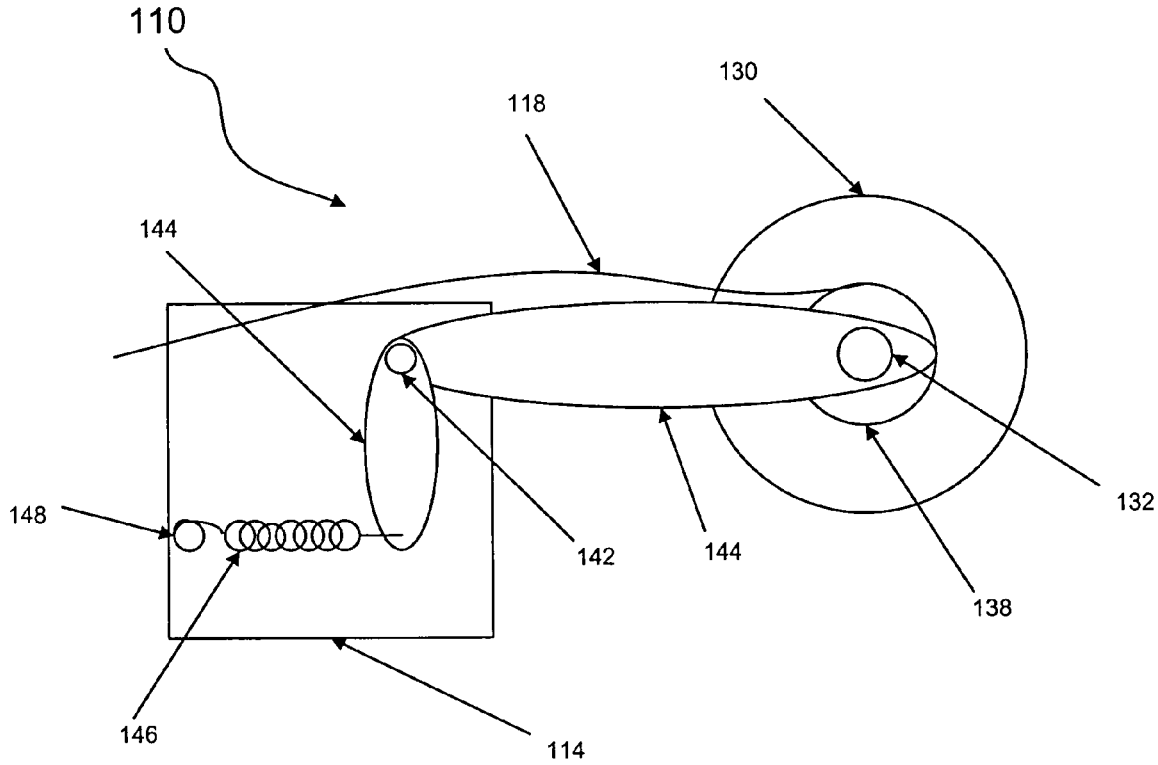
FIG. 5 is a top view of a first exemplary embodiment of the present invention.
Figure 6:
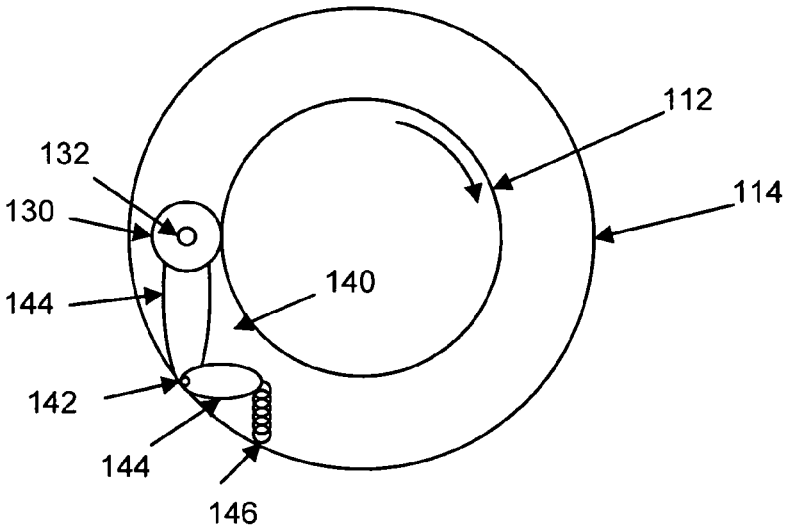
FIG. 6 is a cross-sectional top view of the first exemplary embodiment of the present invention, in accordance with FIG. 5, connecting a rotary member to a stator member.
Figure 7:
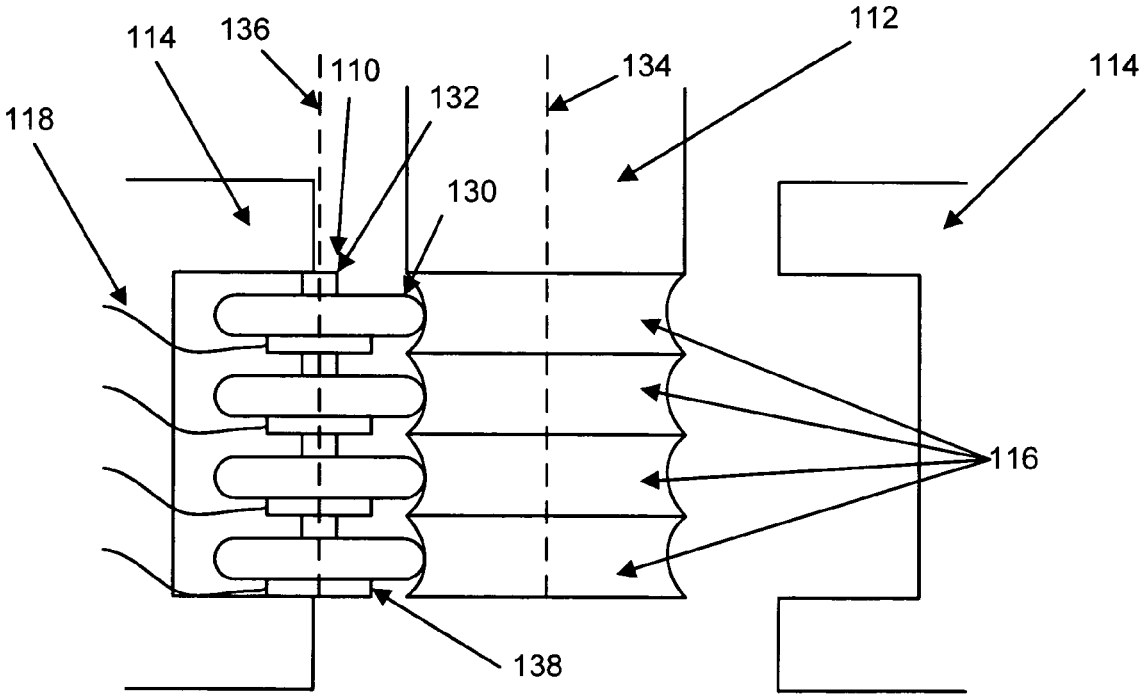
FIG. 7 is a side view of the first exemplary embodiment of the present invention, in accordance with FIG. 5 and FIG. 6, connecting a rotary member to a stator member.

The transfer apparatus 110, as shown in FIG. 5, FIG. 6, and FIG. 7 contains electrical transfer components which provide an electrical connection between a rotating object 112 and a stator base 114. The transfer apparatus 110 includes the stator base 114 mounted proximate to the rotating object 112. At least one conductive disk 130 is rotatably mounted to the stator base 114 by an axle 132. The conductive disk 130 is held against the rotating object 112. As the rotating object 112 rotates about a first axis 134, the conductive disk 130 is made to rotate about a second axis 136, the second axis 136 maintaining a substantially static position. A rotationally immobile contact 138 is maintained in substantial electronic contact with the conductive disk 130 whereby a lead wire 118 may be connected to the immobile contact 138.

A typical application for the transfer apparatus 110 is to electrically connect a constantly revolving nautical antenna to static controls and power supplies within a ship. In one example of such an application, current travels from a power source to the lead wire 118, which may be supported along the stator base 114. The current then travels from the lead wire 118 to the immobile contact 138. The current then travels from the immobile contact 138 to the conductive disk 130. The current then travels from the conductive disk 130 to a rotary contact 116, which is part of the rotating object 112. Finally the current travels from the rotary contact 116 to the intended destination within the nautical antenna. The current may then travel back to the power source along a similar path. Thus, the transfer apparatus 110 completes the electrical transfer between the rotating object 112 and the stator base 114.

The transfer apparatus 110 may include a biasing mechanism 140 mounted between the stator base 114 and the conductive disk 130. The biasing mechanism 140 biases the conductive disk 130 against the rotating object 112. In the first exemplary embodiment, the biasing mechanism 140 includes a pivot shaft 142 mounted to the stator base 114. At least one pivot arm 144 is mounted to the conductive disk 130 by at least one axle 132 and pivotably mounted to the pivot shaft 142. At least one elastic member 146 is mounted to the stator base 114 to bias the pivot arm 144 toward the rotating object 112 and about the pivot shaft 142.

Figure 8:
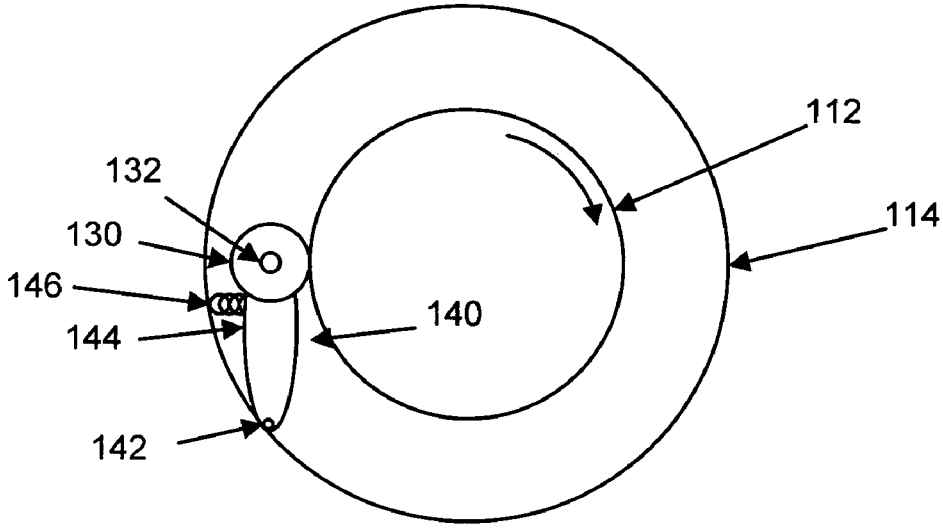
FIG. 8 is a cross-sectional top view of a second exemplary embodiment of the present invention connecting a rotary member to a stator member.

The implementation of the elastic member 146 includes a number of different possibilities. As shown in FIG. 5, the elastic member 146 may be a spring. The elastic member 146 may also be rubber or some other material having resilient mechanical qualities, which would be known to those having ordinary skill in the art. In the first exemplary embodiment, as shown in FIG. 6, the elastic member 146 may be positioned to pull the conductive disk 130 toward the rotating object 112. In a second exemplary embodiment, as shown in FIG. 8, the elastic member 146 may be positioned to push the conductive disk 130 toward the rotating object 112. Other techniques known to those having ordinary skill in the art may similarly be used to apply pressure to the conductive disks 130, biasing the conductive disks 130 against the rotating object 112.

In many applications, the rotating object 112 will have multiple circuits. When the rotating object 112 has multiple circuits, as shown in FIG. 7, the transfer apparatus 110 can be constructed to transfer current along multiple circuits. Providing the transfer apparatus 110 with multiple circuits requires a plurality of conductive disks 130 and a plurality of pivot arms 144. A separate conductive disk 130 is used for each circuit. In one embodiment, each circuit has an independent conductive disk 130, pivot arm 144, elastic member 146, and axle 132, such that each conductive disk 130 is independently biased against the rotating object 112.

One of the advantages of the present design is that frictional wear and debris between the rotating object 112 is minimized by minimizing the rubbing between the rotating object 112 and the conductive disk 130. Specifically, the conductive disk 130 is propelled to rotate by a force provided by a rotation of the rotating object 112. During operation, the conductive disk 130 rotates at an angular disk speed and the rotating object 112 rotates at an angular rotary speed. Preferably, the linear speed along the circumference of the conductive disk 130 is substantially equivalent to the linear speed along the circumference of the rotating object 112, although the conductive disk 130 and the rotating object 112 rotate in opposing directions, such that no rubbing exists between the rotating object 112 and the conductive disk 130. Also, although the transfer apparatus 110 is designed to transfer current between static and rotating points, the transfer apparatus 110 will transfer current between the static base 114 and the rotating object 112 when both the static base 114 and the rotating object 112 are in relatively static positions.

Figure 9:
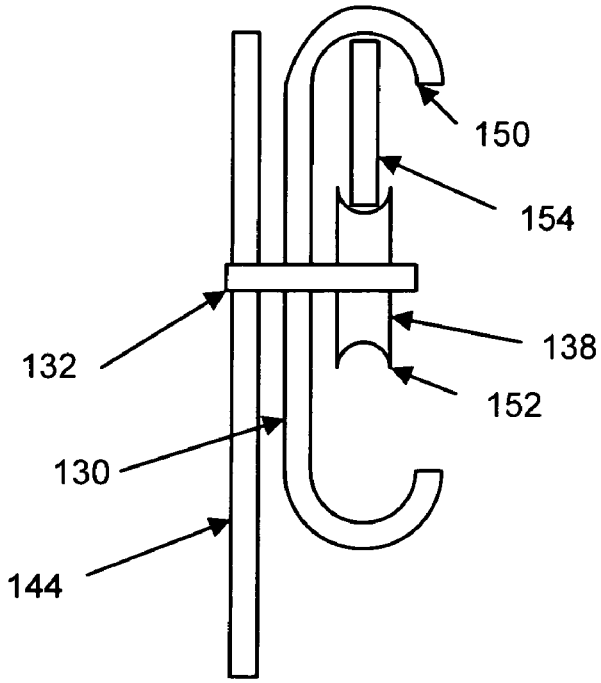
FIG. 9 is a cross-sectional side view of a portion of the second exemplary embodiment of the present invention, in accordance with FIG. 8.

Several possible embodiments exist for the electrical connection between the conductive disk 130 and the immobile contact 138. In the first exemplary embodiment, shown in FIG. 7, the conductive disk 130 and the immobile contact 138 are adjacent to each other. The immobile contact 138 may be machined into the conductive disk 130. In the second exemplary embodiment, shown in FIG. 8 and FIG. 9, the conductive disk 130 has an arcuate portion 150 and the immobile contact 138 has an arcuate circumference 152. A coupling 154 is engaged between the arcuate portion 150 of the conductive disk 130 and the arcuate circumference 152 of the immobile contact 138 for completing electrical contact between the conductive disk 130 and the immobile contact 138. The coupling 154 may be rounded such that the coupling freely rotates in a space defined by the arcuate portion 150 and the arcuate circumference 152. Even if the conductive disk 130 and the immobile contact 138 are machined together, the conductive disk 130 maintains rotational freedom in relation to the immobile contact 138.

Figure 10:
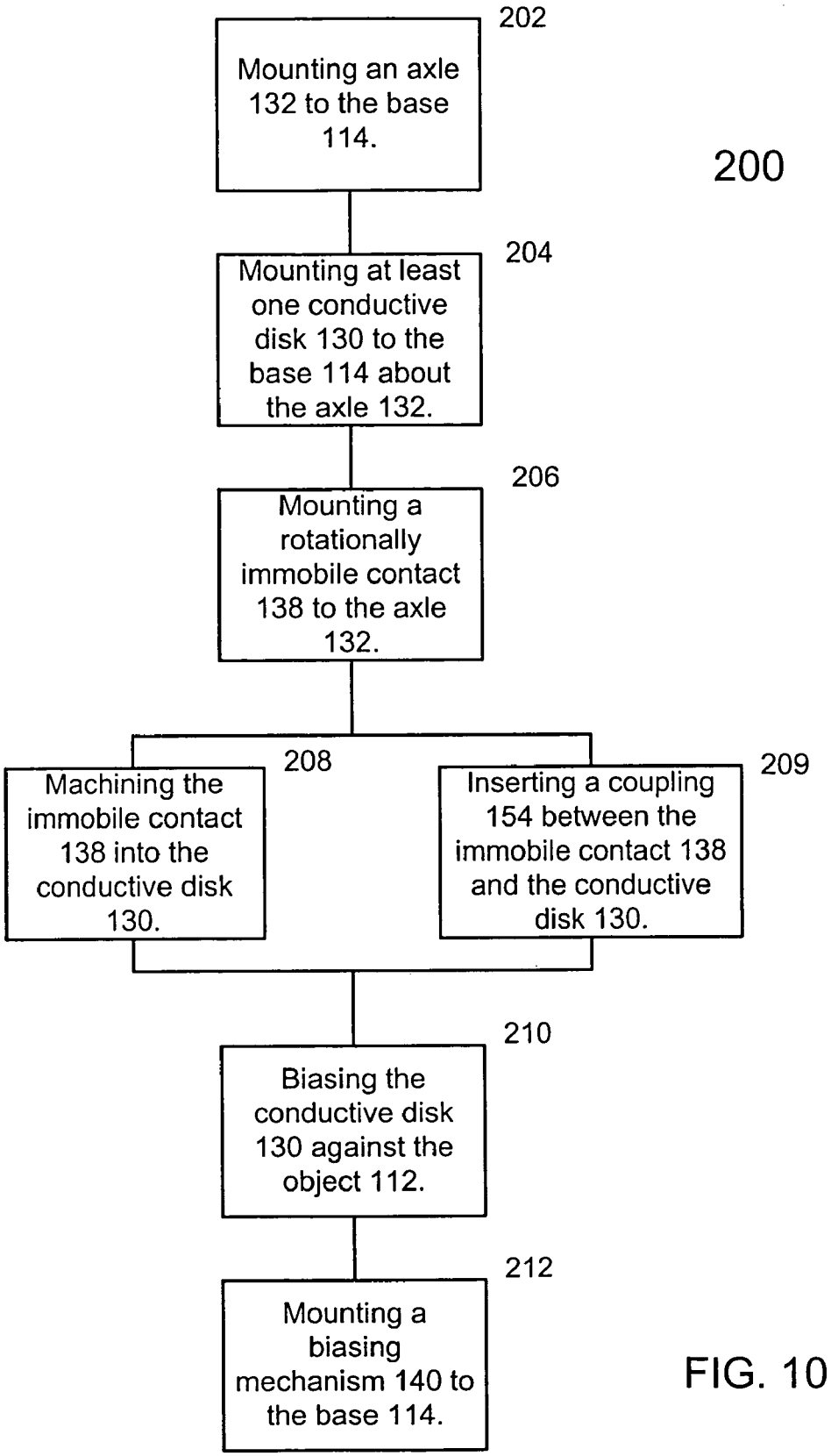
FIG. 10 is a flow chart of a method of making electrical contact between a stator base and a rotary member.

The flow chart of FIG. 10 shows the architecture, functionality, and operation of a possible implementation of the transfer apparatus 110. In this regard, each block represents a module, segment, or step, which comprises one or more executable instructions for implementing the specified logical function. It should also be noted that in some alternative implementations, the functions noted in the blocks might occur out of the order noted in FIG. 10. For example, two blocks shown in succession in FIG. 10 may in fact be executed substantially concurrently or the blocks may sometimes be executed in the reverse order, depending upon the functionality involved, as will be further clarified herein.

The present invention includes a method 200 for making an electrical connection to a rotating object 112 rotating about a first axis 134 from a stator base 114 mounted proximate to the rotating object 112. The method 200 includes mounting an axle 132 to the stator base 114 (block 202). In addition, the method 200 involves rotatably mounting at least one conductive disk 130 to the stator base 114 about the axle 132 (block 204), the conductive disk 130 being held against the rotating object 112, wherein rotation of the rotating object 112 causes the conductive disk 130 to rotate about a second axis 136 while maintaining a substantially static position. Further, the method 200 involves mounting a rotationally immobile contact 138 to the axle 132 (block 206), in substantial electrical contact with the conductive disk 130 whereby a lead wire 118 may be connected to the immobile contact 138.

The method 200 may further involve machining the immobile contact 138 into the conductive disk 130 (block 208), wherein the conductive disk 130 remains rotationally free relative to the immobile contact 138. The method 200 may further involve inserting a coupling 154 between the immobile contact 138 and the conductive disk 130 (block 209). The method 200 may further involve biasing the conductive disk 130 against the rotating object 112 (block 210). The method 200 may further involve mounting a biasing mechanism 140 to the stator base 114 (block 212) to bias the conductive disk 130 against the rotating object 112 (block 210). Mounting the axle 132 to the stator base 114 (block 202) may involve mounting a pivot shaft 142 to the stator base 114, mounting a pivot arm 144 pivotably to the pivot shaft 142, and mounting the axle 132 to the pivot arm 144. Mounting a biasing mechanism 140 to the stator base 114 (block 212) may involve mounting an elastic member 146 to the stator base 114, the elastic member 146 causing the pivot arm 144 to pivot at the pivot shaft 142 and bias the axle 132 and the conductive disk 130 toward the rotating object 112.

It should be emphasized that the above-described embodiments of the present invention are merely possible examples of implementations, merely set forth for a clear understanding of the principles of the invention. Many variations and modifications, such as making the stator base 114 rotate and/or making the rotating base 112 static, may be made to the above-described embodiments of the invention without departing substantially from the spirit and principles of the invention. All such modifications and variations are intended to be included herein within the scope of this disclosure and the present invention and protected by the following claims.

We claim:

1. A transfer apparatus for providing an electrical connection to an object rotating on a first axis, said apparatus comprising:

a base mounted proximate to the object;

an axle mounted to the base;

at least one conductive disk rotatably mounted to the axle, the conductive disk held against the object, wherein the conductive disk rotates about a second axis while maintaining a substantially static position; and a rotationally immobile contact is maintained in substantial electrical contact with the conductive disk whereby a lead wire may be connected to the immobile contact.

2. The transfer apparatus of claim 1 further comprising a biasing mechanism mounted between the base and the axle, wherein the biasing mechanism biases the axle and the conductive disk against the object.

3. The transfer apparatus of claim 2 wherein the biasing mechanism further comprises:

a pivot shaft mounted to the base;

at least one pivot arm mounted to the axle and pivotably mounted to the pivot shaft; and at least one elastic member mounted to bias the pivot arm about the pivot shaft and toward the object.

4. The transfer apparatus of claim 3 wherein the elastic member is a spring.

5. The transfer apparatus of claim 3 wherein the at least one conductive disk comprises a plurality of conductive disks and wherein at least one pivot arm comprises a plurality of pivot arms.

6. The transfer apparatus of claim 5 wherein at least one elastic member comprises a plurality of elastic members and wherein a ratio of 1:1:1 exists between the conductive disks, the pivot arms, and the elastic members.

7. The transfer apparatus of claim 6 further comprising a plurality of axles, wherein each conductive disk is independently biased against the object.

8. The transfer apparatus of claim 1 wherein the conductive disk is propelled to rotate by a force provide by a rotation of the object.

9. The transfer apparatus of claim 1 wherein an angular disk speed of the conductive disk is substantially equivalent to an angular rotary speed of the rotating object.

10. The transfer apparatus of claim 1 wherein the conductive disk has an arcuate section and the immobile contact has an arcuate circumference and a coupling electrically connecting the arcuate section to the arcuate circumference.

11. The transfer apparatus of claim 1 further comprising a coupling electrically connecting the immobile contact and the conductive disk.

12. A method for making an electrical connection to an object constantly rotating about a first axis from a base mounted proximate to the object, the method comprising the steps of:

mounting an axle to the base;

rotatably mounting at least one conductive disk to the base about the axle, the conductive disk held against the object, wherein rotation of the object causes the conductive disk to rotate about a second axis while maintaining a substantially static position; and mounting a rotationally immobile contact to the axle and in substantial electrical contact with the conductive disk whereby a lead wire may be connected to the immobile contact.

13. The method of claim 12 further comprising the step of mounting a freely rotating coupling between the immobile contact and the conductive disk.

14. The method of claim 13 wherein the step of mounting a freely rotating coupling between the immobile contact and the conductive disk further comprises pressure fitting the coupling between the immobile contact and the conductive disk.

15. The method of claim 12 further comprising the step of biasing the conductive disk against the object.

16. The method of claim 15 further comprising the step of mounting a biasing mechanism to the base to bias the conductive disk against the object.

17. The method of claim 16 wherein the step of mounting the axle to the base further comprises:

mounting a pivot shaft to the base;

mounting a pivot arm pivotably to the pivot shaft; and mounting the axle to the pivot arm.

18. The method of claim 17 wherein the step of mounting a biasing mechanism to the base further comprises mounting an elastic member to the base, the elastic member causing the pivot arm to pivot at the pivot shaft and bias axle and conductive disk toward the object.

* * * * *